US005104148A

United States Patent [19]

Neal

[11] Patent Number: 5,104,148

[45] Date of Patent: Apr. 14, 1992

[54] AUTO KEY RING IDENTIFICATION TAG PRODUCT

[75] Inventor: Christopher B. Neal, Farmington Hills, Mich.

[73] Assignee: Wallace Computer Services, Inc., Hillside, Ill.

[21] Appl. No.: 735,191

[22] Filed: Jul. 24, 1991

Related U.S. Application Data

[63] Continuation of Ser. No. 616,644, Nov. 21, 1990, abandoned.

[51] Int. Cl.[5] ..... B42D 15/00

[52] U.S. Cl. ..... 283/81; 428/42; 40/638

[58] Field of Search ..... 283/81; 428/40, 42; 40/630, 638

[56] References Cited

U.S. PATENT DOCUMENTS

| | | | |
|---|---|---|---|
| 2,213,666 | 9/1940 | Burke | 283/81 |
| 3,994,085 | 11/1976 | Graselak et al. | 283/81 |
| 4,110,502 | 8/1978 | Baer | 283/81 |
| 4,112,603 | 9/1978 | Giulie | 283/80 |
| 4,521,981 | 6/1985 | Kasprzycki et al. | 283/56 |
| 4,544,182 | 10/1985 | Spring | 283/81 |
| 4,680,210 | 7/1987 | Corcoran | 428/42 |
| 4,914,843 | 4/1990 | De Waskin | 283/75 |
| 4,978,146 | 12/1990 | Warther et al. | 283/81 |
| 5,029,903 | 7/1991 | Pennock | 283/81 |

*Primary Examiner*—P. W. Echols
*Assistant Examiner*—David P. Bryant
*Attorney, Agent, or Firm*—Tilton, Fallon, Lungmus & Chestnut

[57] ABSTRACT

An auto key ring identification tag consisting of a relatively elongated unitary paper member having an enlargement at one end, owner identification indicia on one face of the enlargement, and pressure sensitive adhesive on the other face of the enlargement whereby the enlargement is foldable on itself to capture the other end of the member to form a loop around the key ring. The tags are arranged on a sheet of release film in two tiers, with the members in one tier being reversely oriented relative to the members in the other tier to position the other ends of the members in one tier between the enlargements of the other tier.

2 Claims, 1 Drawing Sheet

AUTO KEY RING IDENTIFICATION TAG PRODUCT

This application is a continuation of application Ser. No. 07/616,644, filed Nov. 21, 1990, now abandoned.

BACKGROUND AND SUMMARY OF INVENTION

This invention relates to an auto key ring identification tag and method and, more particularly, to a tag loopable through the key ring and attached to itself.

In the past, service departments of automotive agencies and other retail stores have employed a variety of tags for identifying the owner of an automobile being serviced. In many cases, a plastic key ring tag similar to a plastic bag tie was employed. The product was expensive in addition to not being recyclable.

According to the invention, durable paper face stock is die cut to provide a relatively elongated member having an enlarged part at one end and a constricted part at the other, one face of the enlarged part being equipped with owner identification indicia and the other face being equipped with a pressure sensitive adhesive.

Other objects and advantages of the invention may be seen in the details of the ensuing specification.

BRIEF DESCRIPTION OF THE DRAWINGS

The invention is described in conjunction with an illustrated embodiment in which.

DETAILED DESCRIPTION

Figure 1:
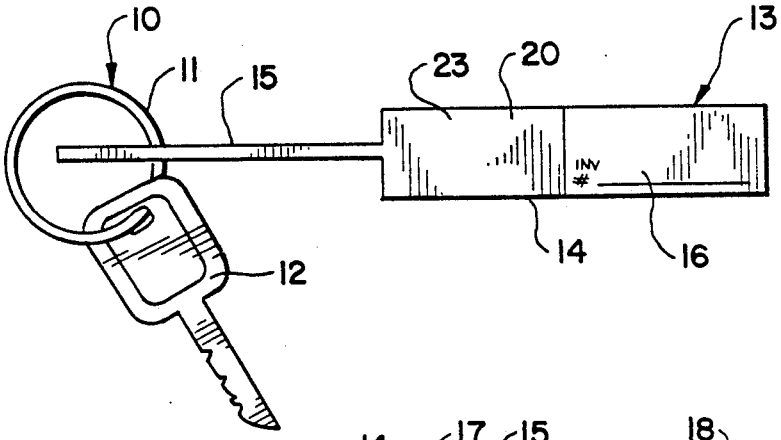
FIG. 1 is a plan view of the inventive tag shown with the constricted end being applied to the ring of an auto key ring.

With reference first to FIG. 1 the numeral 10 designates generally an automotive key ring consisting of the ring itself as at 11 and an ignition key as at 12. One or more keys are left with the service department of an automotive agency and it is necessary for the agency to tag the key which is normally removed from the ignition after the automobile has been serviced. The identification according to the invention is provided in the form of a relatively elongated member generally designated 13.

The member 13 has at one end a relatively transversely enlarged part 14 and at the other end a relatively constricted part 15. The enlarged part 14 is equipped with owner identification indicia 16 which may take the form of "INV. #" followed by a line for insertion of the appropriate invoice number.

Figure 2:
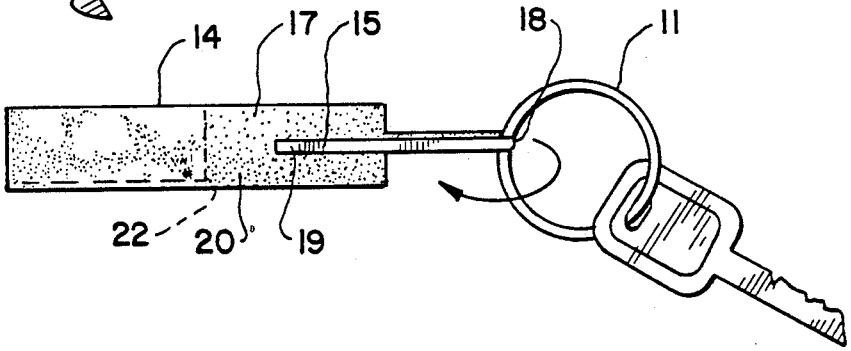
FIG. 2 is a bottom plan view showing the next step in the application of the tag wherein the constricted end is looped on itself and applied to an adjacent section of the enlarged part.

The other face of the member 13—see FIG. 2—is equipped with pressure sensitive adhesive as at 17.

It will be noted that, in the illustration given, the constricted part 15 is of approximately the same length as the transversely enlarged part 14. In use, the constricted part 15 is folded on itself—see FIG. 2—with an intermediate section 18 in contact with the key ring 11 and providing a free end as at 19 in contact with an adjacent section 20 of the enlarged part 14.

Figure 3:
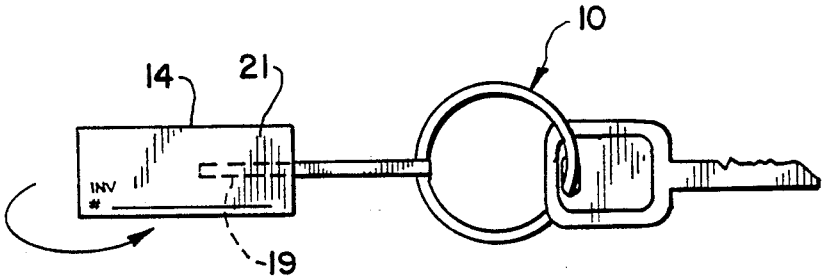
FIG. 3 is another bottom plan view of the inventive member and key ring wherein the enlarged part has been folded on itself to capture the constricted part.

Thereafter, as shown in FIG. 3, a section 21 of the enlarged part 14 is folded over the adjacent part 20 and thereby captures between the pressure sensitive adhesive equipped faces the free end 19 of the identification tag.

The enlarged part 14—see FIG. 2—is equipped with a line of weakness, i.e., perforation 22 generally centrally longitudinally of the enlarged part 14. This then defines the sections 20 and 21 and facilitates the folding operation illustrated in FIG. 3. Additionally, the provision of two portions on the enlarged part as at 20 and 21 permits one section to carry the owner identification indicia as at 16 and the other section to carry advertising indicia as at 23.

Another advantageous feature of the invention resides in the means for providing a product consisting of a plurality of the members 13. This can be appreciated from a consideration of FIG. 4.

Figure 4:
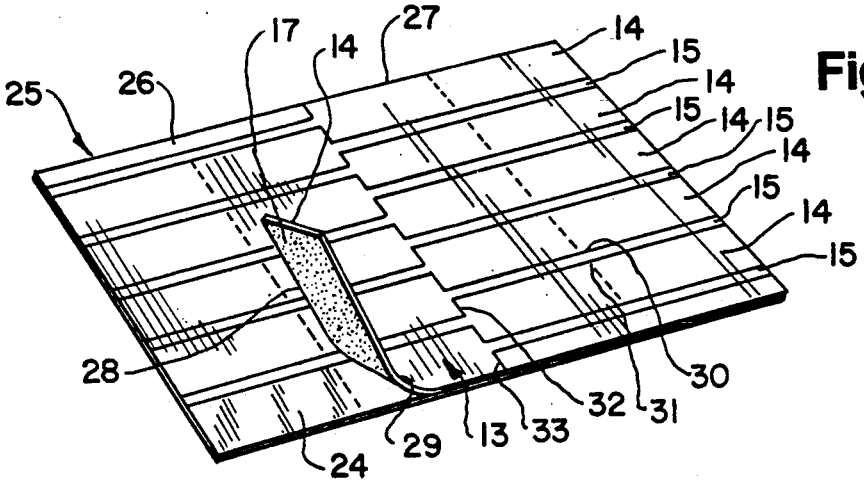
FIG. 4 is a perspective view of a product made up of a plurality of the inventive key tag members with one member in the process of being detached from the underlying release liner.

In FIG. 4, the numeral 24 designates a release liner which generally is constructed of silicone film or the like and which permits ready detachment of paper as at 13 equipped with pressure sensitive adhesive 17 on the face confronting the film 24 to provide the product generally designated 25.

A plurality (ten as illustrated) of the members 13 are provided in two tiers as at 26 and 27 with the constricted parts 15 of the tier 26 (for example) being interspersed or flanking the enlarged parts 14 of the members in the second tier 27—and vice versa. This affords a compact, readily manipulatable and inexpensive source for the members 13.

It also provides an advantageous method of production inasmuch as each enlarged part 14 is defined by parallel die cut lines as at 28, 29. The constricted part 15 is also defined by a pair of die cut lines as at 30, 31 with the constricted part 15 being centrally positioned transversely relative to the enlarged part 14. Advantageously, the width, i.e., the transverse dimension of the constricted part 15 is less than about one-half the transverse dimension of the enlarged part 14.

The adjacent ones of the two pairs 28, 29 and 30, 31 of the die cut lines are connected by transverse die cut lines as at 32, 33.

Operation

When it becomes necessary to tag a key ring 11 so as to properly identify the owner of the key 12, a member 13 is peeled from the film 24 (see FIG. 4) and arranged with the constricted part 15 overlying the key ring 11 as seen in FIG. 1. An intermediate section 18 is in contact with the key ring—see FIG. 2—and the constricted part 15 is folded on itself to apply the free end 19 to the adjacent portion 20 of the enlarged part 14. Thereafter the remaining portion 21 is folded over the adjacent portion 20 to capture the free end 19.

Thereafter, the identification of the key owner as by invoice number is written on the portion 21. A line of weakness 22 such as a perforation, facilitates the folding over operation depicted in FIG. 3.

An additional advantages accrues from the fact that the paper tag was much easier to write on than previously employed plastic. Further, inasmuch as only one portion 21 is needed for the key identification, the other portion 20 can be used for advertising and if the advertiser is someone other than the service agency, the cost of the tag can be reduced or offset.

While in the foregoing specification a detailed description of an embodiment of the invention is set down for the purpose of illustration, many variations in the details hereingiven may be made by those skilled in the art without departing from the spirit and scope of the invention.

I claim:

1. An auto key ring identification tag product comprising a generally rectangular sheet of release film and a plurality of relatively elongated paper tag members, each member having an enlargement at one end and owner identification indicia, on said enlargement, on one face thereof, the other face being equipped with pressure sensitive adhesive and arranged in contacting relation to said film, each enlargement being generally rectangular and extending over approximately one-half the length of said member, the other end also being generally rectangular and having a transverse dimension less than one-half the transverse dimension of said enlargement, said members being arranged on said sheet of release film in two tiers with the members in one tier being reversely oriented relative to the members in the other tier to position the other ends of the members in one tier between the enlargements of the other tier.

2. The product of claim 1 in which each enlargement is equipped with a transverse line of weakness generally midway of the length of said enlargement to provide two generally equal enlargement portions, said identification indicia being on one of said portions, the other of said portions being equipped with advertising indicia.

* * * * *